US007830230B2

(12) United States Patent
Schaltenbrand et al.

(10) Patent No.: US 7,830,230 B2
(45) Date of Patent: Nov. 9, 2010

(54) HANDLE ARM AND UNDERVOLTAGE RELEASE AND CIRCUIT INTERRUPTER INCORPORATING THE SAME

(75) Inventors: Brian J. Schaltenbrand, Pittsburgh, PA (US); Robert W. Mueller, Aliquippa, PA (US); Mark A. Janusek, Pittsburgh, PA (US); William M. Randal, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 313 days.

(21) Appl. No.: 12/164,722

(22) Filed: Jun. 30, 2008

(65) Prior Publication Data

US 2009/0322452 A1 Dec. 31, 2009

(51) Int. Cl.
*H01H 83/00* (2006.01)

(52) U.S. Cl. ..... 335/6; 335/20

(58) Field of Classification Search ..... 335/6, 335/20–21, 172–176

See application file for complete search history.

(56) References Cited

U.S. PATENT DOCUMENTS

| | | | | |
|---|---|---|---|---|
| 3,147,353 | A * | 9/1964 | Leonard | 337/97 |
| 7,369,021 | B2 | 5/2008 | Bogdon et al. | |
| 2006/0071740 | A1 * | 4/2006 | Bogdon et al. | 335/14 |

* cited by examiner

*Primary Examiner*—Ramon M Barrera
(74) *Attorney, Agent, or Firm*—Martin J. Moran

(57) ABSTRACT

A handle arm assembly is for a circuit interrupter including an undervoltage release mechanism having a reset mechanism. The handle arm assembly includes a body portion rotatable through an arc between an on position, an off position, and a reset position beyond the off position and an arm portion projecting laterally from the body portion out of the plane of the arc through which the body portion rotates. The body portion and the arm portion are formed from a single piece of material wherein the body portion and the arm portion are different portions of the single piece of material. The arm portion is structured to engage the reset mechanism in a manner such that arcuate movement of the arm portion as the body portion moves to the off position is translated into actuation of the reset mechanism.

19 Claims, 5 Drawing Sheets

HANDLE ARM AND UNDERVOLTAGE RELEASE AND CIRCUIT INTERRUPTER INCORPORATING THE SAME

BACKGROUND OF THE INVENTION

1. Field of the Invention

The invention relates to circuit interrupters and, more particularly, to circuit breakers with mechanisms that trip the circuit breaker when voltage in the protected circuit drops below a specified value. The invention also relates to handle arms used in such mechanisms.

2. Background Information

Circuit interrupters, such as, for example, circuit breakers, primarily provide protection from excessive current in an electric power distribution system. Some circuit breakers additionally provide protection against low voltage that could damage or cause misoperation of equipment in the protected circuit. Typically, low voltage protection is provided by an undervoltage release (UVR) that includes a coil energized by the protected circuit. As long as the voltage remains above a predetermined dropout level, the magnetic force generated by the coil is sufficient to maintain a plunger in a retracted position. However, when the voltage drops below the predetermined dropout level, a compression spring overcomes the magnetic force and extends the plunger out of the coil to actuate the trip mechanism of the circuit breaker. The magnetic force generated by the coil is not sufficient to retract the plunger against the bias of the compression spring even if it returns to full value. Consequently, a reset lever is provided to mechanically retract the plunger.

It is known to actuate the reset lever when the handle of the circuit breaker is returned to the off position, such as shown in U.S. Pat. No. 7,369,021. Such resetting has been accomplished by the interaction of a pin member, separately added to the handle arm, and a reset lever on the overvoltage relay as the handle arm reaches the off position.

While such reset design is effective, there is room for improvement in undervoltage release mechanisms for circuit interrupters. There is also room for improvement in the structure of the mechanisms that reset such release mechanisms and circuit interrupters employing such undervoltage release mechanisms.

SUMMARY OF THE INVENTION

In accordance with one aspect of the invention, a handle arm assembly is provided for a circuit interrupter including an undervoltage release. The undervoltage release comprises an undervoltage relay comprising a plunger that is extended to a trip position when voltage in a protected circuit drops below a predetermined value, and a reset mechanism that retracts the plunger when actuated. The handle arm assembly comprises: a body portion rotatable through an arc between an on position, an off position, and a reset position beyond the off position, and an arm portion projecting laterally from the body portion out of the plane of the arc through which the body portion rotates. The arm portion being structured to engage the reset mechanism in a manner such that arcuate movement of the arm portion as the body portion moves to the off position is translated into actuation of the reset mechanism. The body portion and the arm portion being formed from a single piece of material wherein the body portion and the arm portion are different portions of the single piece of material.

The single piece of material may be made of 1070 steel.

The reset mechanism may comprise a reset lever that retracts the plunger when actuated, and an interface lever between the arm portion of the handle arm assembly and the reset lever.

The body portion and the arm portion may be formed using a progressive die. The body portion may comprise: a central portion having a first end and an opposite second end, a first leg member extending from the first end of the central portion, and a second leg member extending from the opposite second end of the central portion. The central portion, the first leg member, and the second leg member may each be of generally planar shape and the first leg member and the second leg member may be arranged generally perpendicular to the central portion.

The arm portion may project in a direction from one of the first leg member and the second leg member. The arm portion may be of generally planar shape. The direction the arm portion projects may be generally perpendicular to the one of the first leg member and the second leg member. The central portion may be structured to be coupled to a handle member.

As another aspect of the invention, a circuit interrupter comprises: a housing; separable contacts; an undervoltage release comprising an undervoltage relay comprising a plunger that is extended to a trip position when voltage in a protected circuit drops below a predetermined value, and a reset mechanism that retracts the plunger when actuated; and an operating mechanism structured to open and close the separable contacts. The operating mechanism comprises: a handle portion; a body portion coupled to the handle portion and being rotatable through an arc between an on position, an off position, and a reset position beyond the off position; and an arm portion projecting laterally from the body portion out of the plane of the arc through which the body portion rotates. The arm portion engaging the reset mechanism in a manner such that arcuate movement of the arm portion as the handle portion moves the body portion to the off position is translated into actuation of the reset lever. The body portion and the arm portion being formed from a single piece of material and the body portion and the arm portion being different portions of the single piece of material.

The single piece of material may be made of 1070 steel.

The reset mechanism may comprise a reset lever that retracts the plunger when actuated, and an interface lever between the arm portion and the reset lever. The body portion and the arm portion may be formed using a progressive die. The body portion may comprise: a central portion coupled to the handle portion, the central portion having a first end and an opposite second end; a first leg member extending from the first end of the central portion; and a second leg member extending from the opposite second end of the central portion.

The central portion, the first leg member, and the second leg member may each be of generally planar shape. The first leg member and the second leg member may be arranged generally perpendicular to the central portion.

The arm portion may project in a direction from one of the first leg member and the second leg member. The direction may be generally perpendicular to the one of the first leg member and the second leg member. The arm portion may be of generally planar shape.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
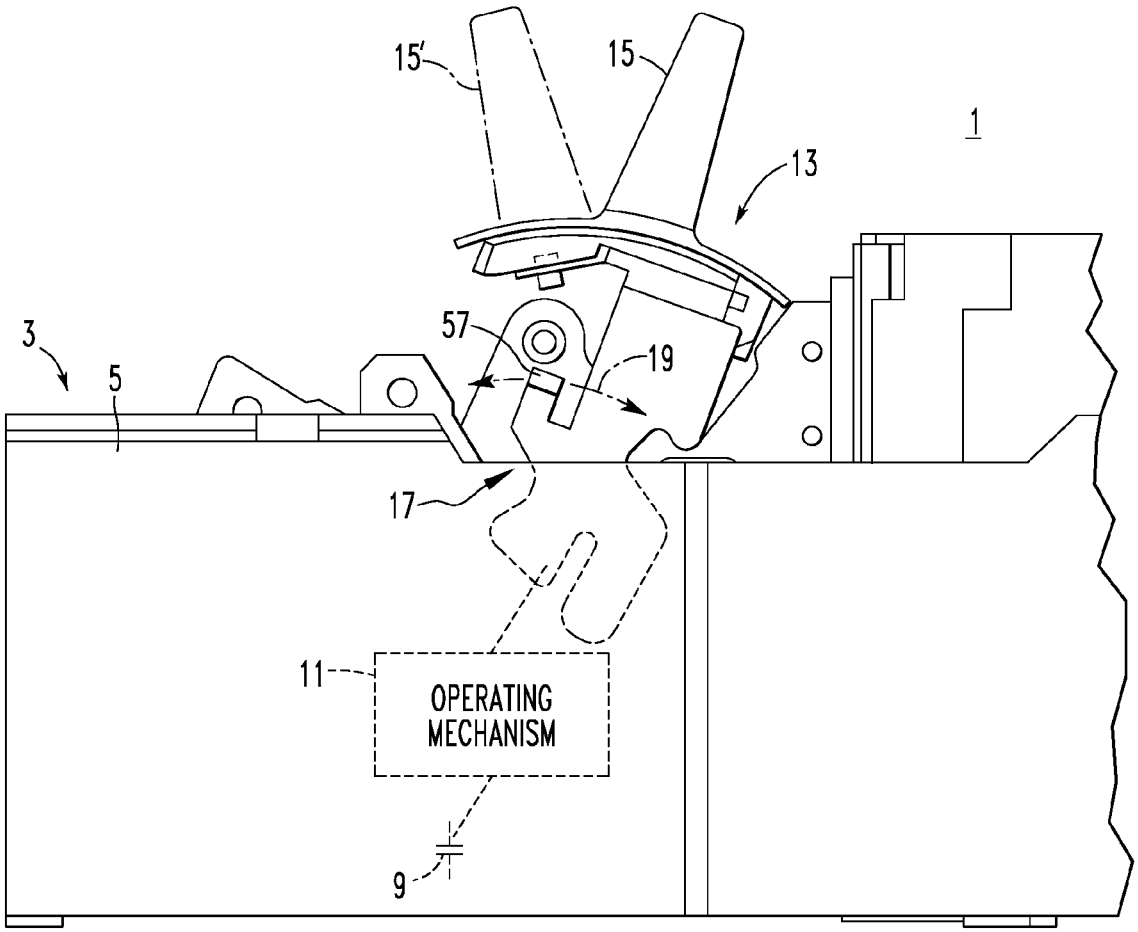
FIG. 1 is a side elevation view of a circuit breaker in accordance with an embodiment of the invention shown with the cover removed.
Figure 2:
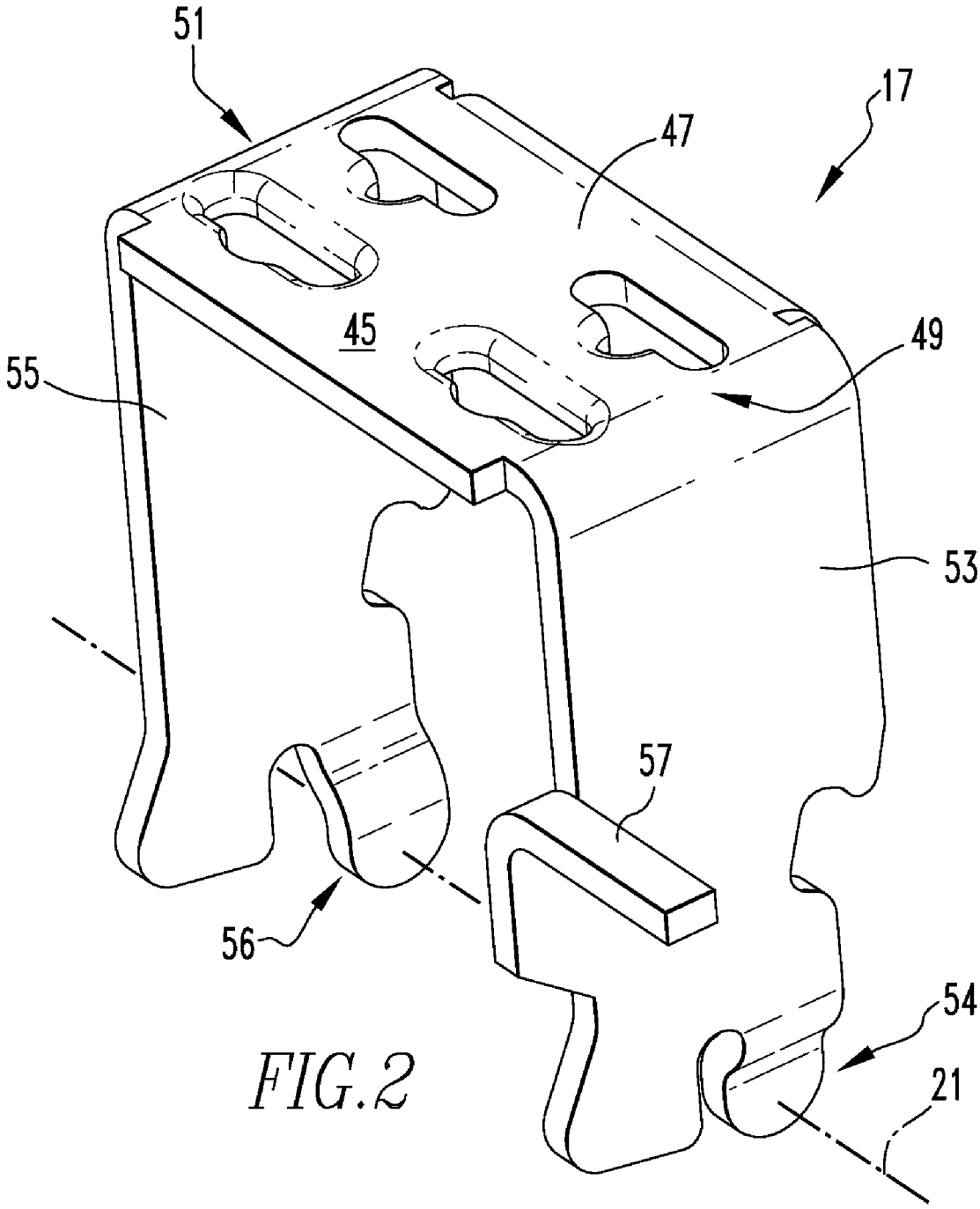
FIG. 2 is an isometric view of an improved handle arm assembly in accordance with an embodiment of the invention.
Figure 3:
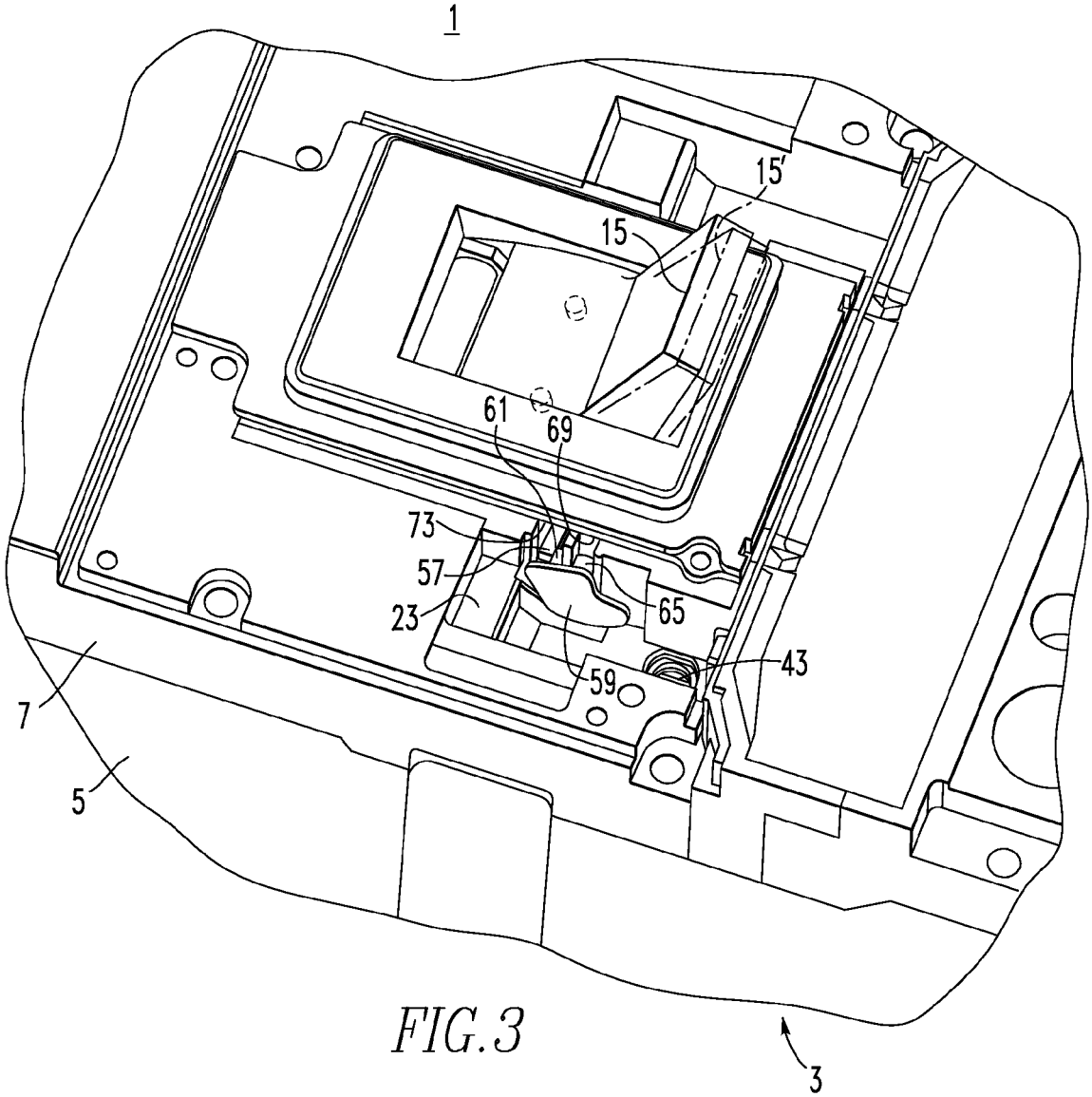
FIG. 3 is a fractional isometric view from above the circuit breaker of FIG. 1 illustrating the position of the handle arm within the circuit breaker housing.
Figure 4:
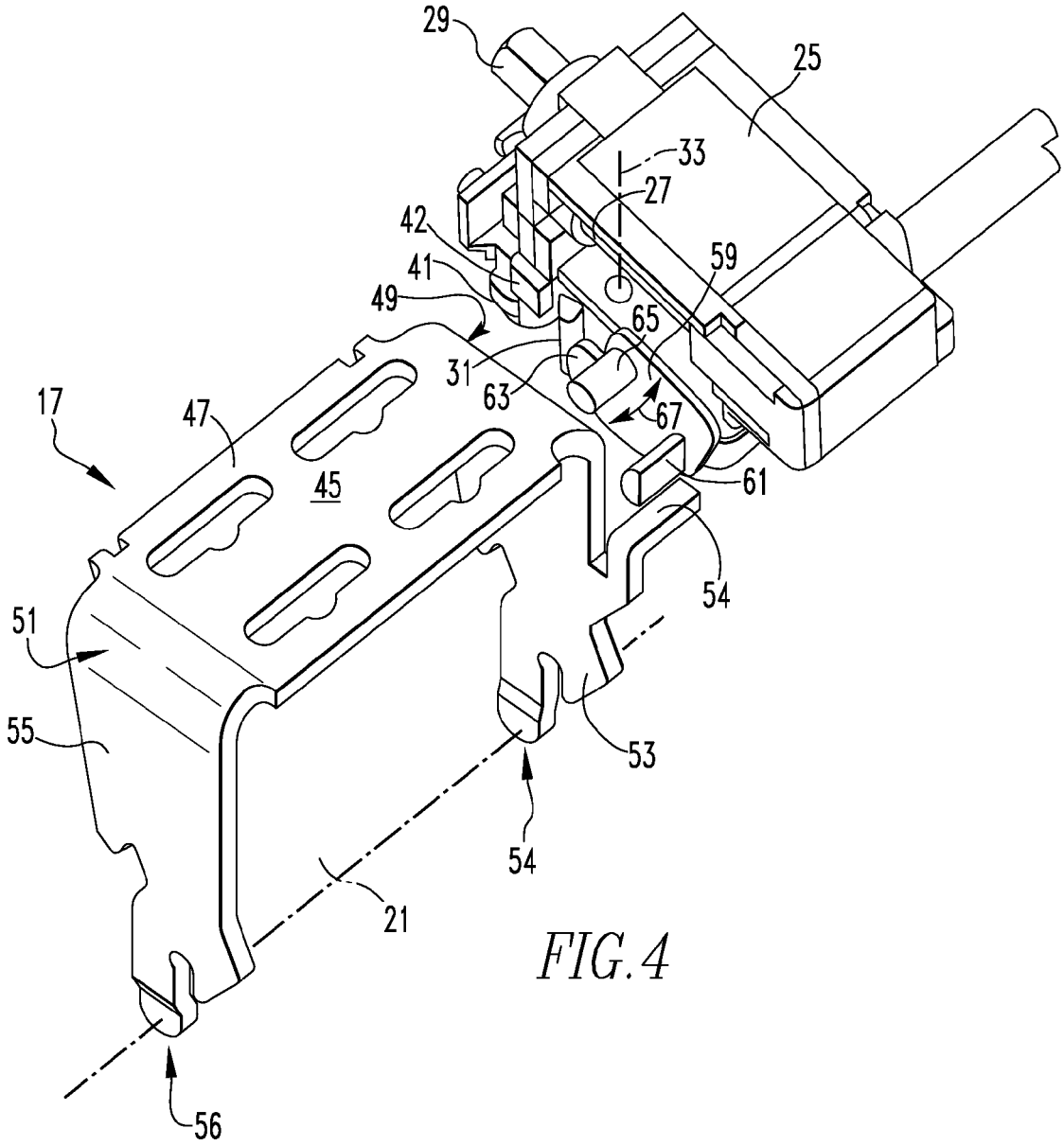
FIG. 4 is an isometric view illustrating the coupling of the handle arm of FIG. 2 to the undervoltage relay by the interface lever.
Figure 5:
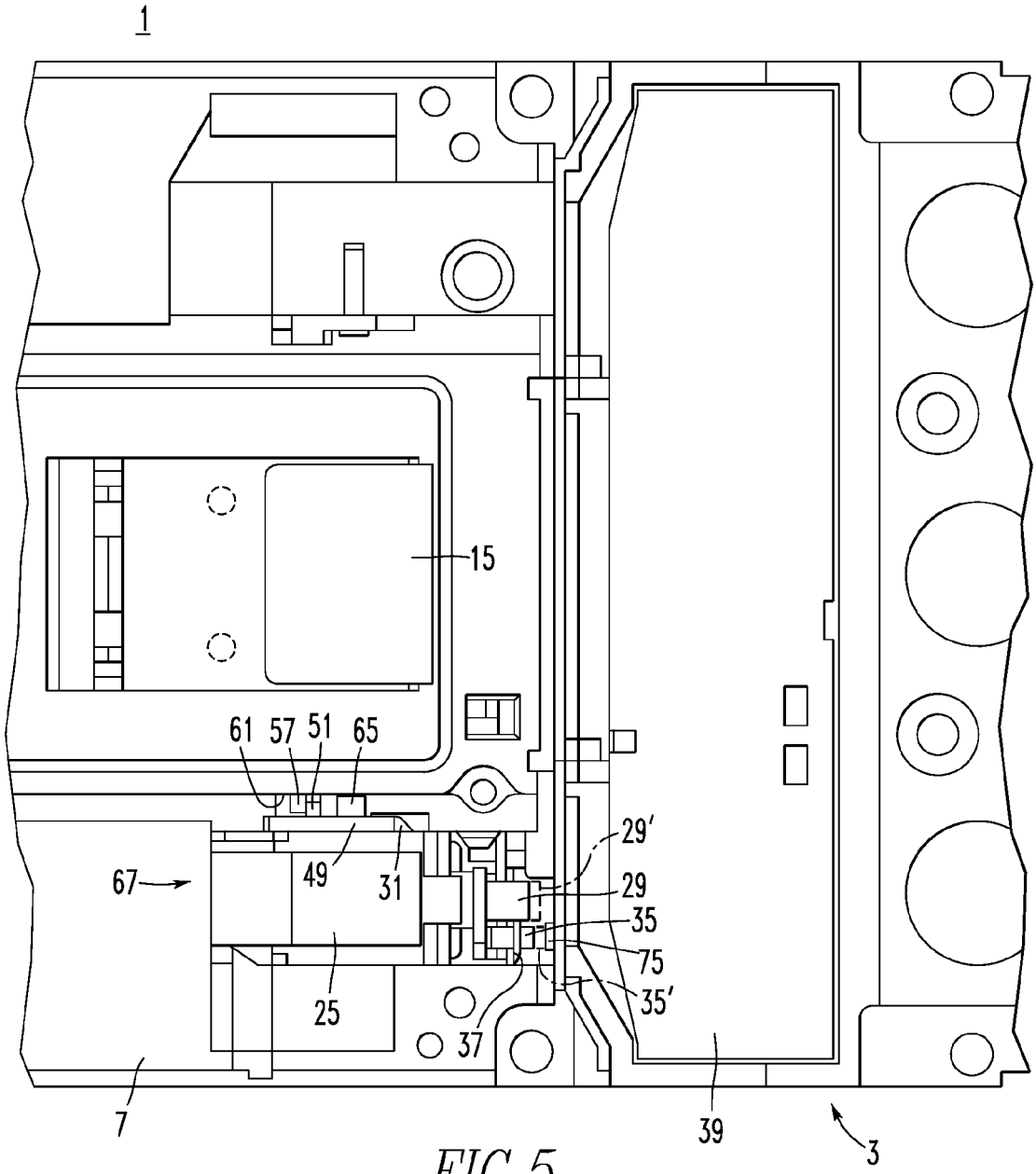
FIG. 5 is a top plan view of the circuit breaker of FIG. 1 with the handle arm installed.

Referring to FIGS. 1, 3 and 5, a circuit breaker 1 incorporating aspects of the invention, has a housing 3 formed by a base 5 and primary cover 7 as shown in FIG. 3. Such a circuit breaker 1 has separable contacts 9 (shown in simplified form in hidden line drawing in FIG. 1) that are opened and closed by an operating mechanism 11 (shown in simplified form in hidden line drawing in FIG. 1). The operating mechanism 11 can be operated manually by an operating member 13 to open and close the separable contacts 9. The operating member includes a handle 15 mounted on a handle arm assembly 17 that is rotatable as shown by the arrows 19 about a pivot axis 21 (FIGS. 2 and 4) between an off position, as shown in FIGS. 1, 3 and 5, and an on position (shown in phantom line drawing in FIG. 1 as 15') in which the handle 15 is rotated counterclockwise (with respect to FIG. 1) from the position shown. The operating member 13 can be rotated further clockwise from the off position, as shown, to a reset position (shown in phantom line drawing in FIG. 3 as 15') to reset the operating mechanism 11 after a trip, all as is well known.

The primary cover 7 has a compartment 23 in which accessories can be installed (see FIG. 3). This compartment 23 is enclosed by a removable secondary cover (not shown) that seats on the primary cover 7.

One of the accessories that can be installed in the compartment 23 is an undervoltage relay 25, an example of which is best shown in FIG. 4. Such an undervoltage relay 25 is known, and has a coil 27 and a plunger 29. A coil spring (not shown) biases the plunger 29 to an extended or actuated position. A reset lever 31 that rotates about an axis 33 mechanically retracts the plunger 29 against the bias of the spring. With the plunger 29 retracted, energization of the coil 27 generates a magnetic force sufficient to hold the plunger in against the bias of the spring. The coil is energized by the line voltage to the circuit breaker 1. If this line voltage falls below a target value, the weakened magnetic force is overcome by the spring and the plunger 29 is actuated (extended). Referring to FIG. 5, an offset plunger 35 is carried by the plunger 29 through an offset bracket 37. The offset plunger 35 is available to register with a trip mechanism, such as trip unit 39, that is not aligned with the main plunger 29. Again referring to FIG. 4, a clamp 41 integrally molded with a housing 42 of the undervoltage relay 25 engages a recess 43 (see FIG. 3) to secure the undervoltage relay 25 in the compartment 23.

Referring to FIG. 2, the handle arm assembly 17 includes a body portion 45. Body portion 45 includes a central portion 47 having a first end 49 and an opposite second end 51. Central portion 47 is structured to have handle 15 coupled thereto, as best shown in FIG. 1. Body portion 45 further includes a first leg member 53 extending from the first end 49 of the central portion 47 to a first terminal portion 54 and a second leg member 55 extending from the opposite second end 51 of the central portion 47 to a second terminal portion 56. First terminal portion 54 and second terminal portion 56 are structured to engage a channel member (not shown) in a manner such that the first leg member 53 and the second leg member 55, and thus body portion 45 may generally pivot about pivot axis 21 (FIGS. 2 and 4).

As shown in FIGS. 2 and 4, central portion 47, first leg member 53 and second leg member 55 are each preferably of generally planar shape with the first leg member 53 and second leg member 55 being oriented generally perpendicular to the central portion 47. First leg member 53 includes an arm portion 57, preferably of generally planar shape, projecting laterally in a direction generally parallel to pivot axis 21 about which the handle arm assembly 17 rotates and being generally perpendicular to the first leg member 53. As such, arm portion 57 generally extends out of the plane of the arc formed by rotation of the body portion 45 about the pivot axis 21. Preferably, the arm assembly 17 is formed from a single piece of material, wherein the body portion 45 and the arm portion 57 comprise different portions of the single piece of material. The single piece of materials includes an elongated opening between the body portion and an elongated portion corresponding to the arm portion; and wherein the elongated portion is disposed perpendicular to the body portion to form the arm portion. An example arm assembly 17, such as shown in FIGS. 2 and 4, may be made from 1070 steel and formed using a progressive die stamping process, although it is to be appreciated that other materials and forming processes may be employed.

The example undervoltage relay 25 (FIG. 4) is reset by movement of the operating member 13 (FIG. 1) through the handle 15 (FIG. 1) to the off position. To this end, arm portion 57 projects laterally out of the plane of rotation of the handle arm 17, and therefore, rotates through the arc depicted by the arrows 19 (FIG. 1). This arcuate movement of the arm portion 57 is translated into rotation of the reset lever 31 on the undervoltage relay 25 by an interface lever 59 (FIGS. 3 and 4). As shown in FIG. 4, the interface lever 59 has a first portion 61 that is engaged by the arm portion 57 and a second portion 63 that engages the reset lever 31. A pivot pin 65 supports the interface lever 59 for arcuate rotation as indicated by the arrows 67.

As best seen in FIG. 3, the pivot pin 65 on the interface lever 59 seats in a slot 69 in the compartment 23 of the primary cover 7. The first portion, which in the example embodiment is in the form of an actuating arm 61, extends through an opening 73 in the cover 7 where it can be engaged by the arm portion 57, as can also be seen in FIG. 3. As also shown in FIG. 5, when the undervoltage relay 25 detects an undervoltage condition, the plunger 29, and therefore the offset plunger 35, extend (as shown in phantom line drawing as 29' and 35') so that the offset plunger 35' actuates a trip button 75 on the trip unit 39 of the circuit breaker 1. This causes the handle 15 and handle arm assembly 17 (FIG. 1) to move to a trip position (not shown), which as is common practice, is between the on and off positions.

When the handle 15 and handle arm assembly 17 are manually moved to the off position, the arm portion 57 engages the actuating arm 61 on the interface lever 59 to rotate and thereby rotate the reset lever 31 to reset the undervoltage relay 25. To reset the circuit breaker operating mechanism 11, the handle 15 and handle arm assembly 17 are moved clockwise, as seen in FIG. 1, past the off position to a reset position (as shown in phantom line drawing in FIG. 3 as 15'). In order to accommodate for this overtravel and for tolerances that affect the coupling between the arm portion 57 and the reset lever 31, the interface lever 59 is preferably provided with compliance that allows it to flex. This flexure could be localized, such as in the actuating arm 61 and/or the second portion 63; however, the example interface lever 59 is integrally molded of a compliant material, such as, for instance, nylon that permits it to flex. In particular, the actuating arm 61 can be tapered as shown to provide the desired flexure. The compliance of the interface lever 59 is such that it is stiff enough to transmit the necessary force from the handle arm portion 57 to the reset lever 31 to reset the undervoltage relay 25, but to then flex during overtravel of the arm portion 57 without applying undue force to the reset lever 31. The undervoltage relay 25, the arm portion 57, and the interface lever 59 form an undervoltage release mechanism 77 that provides reliable resetting of the undervoltage relay 25, yet accommodates for overtravel and the stackup of tolerances without applying undue force to the undervoltage relay 25.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A handle arm assembly for a circuit interrupter including an undervoltage release, said undervoltage release comprising an undervoltage relay comprising a plunger that is extended to a trip position when voltage in a protected circuit drops below a predetermined value, and a reset mechanism that retracts the plunger when actuated, said handle arm assembly comprising:

a body portion rotatable through an arc between an on position, an off position, and a reset position beyond the off position; and an arm portion projecting laterally from the body portion out of the plane of the arc through which the body portion rotates, said arm portion being structured to engage said reset mechanism in a manner such that arcuate movement of the arm portion as the body portion moves to the off position is translated into actuation of the reset mechanism, wherein said body portion and said arm portion are formed from a single piece of material; wherein said body portion and said arm portion are different portions of said single piece of material; wherein the single piece of material includes an elongated opening between said body portion and an elongated portion corresponding to said arm portion; and wherein said elongated portion is disposed perpendicular to said body portion to form said arm portion.

2. The handle arm assembly of claim 1 wherein said reset mechanism comprises a reset lever that retracts the plunger when actuated, and an interface lever between the arm portion of said handle arm assembly and the reset lever.

3. The handle arm assembly of claim 1 wherein said single piece of material is made of 1070 steel.

4. The handle arm assembly of claim 1 wherein said body portion and said arm portion are formed using a progressive die.

5. The handle arm assembly of claim 1 wherein said body portion comprises:

a central portion having a first end and an opposite second end;

a first leg member extending from the first end of said central portion; and a second leg member extending from the opposite second end of said central portion.

6. The handle arm assembly of claim 5 wherein said central portion, said first leg member, and said second leg member are each of generally planar shape; and wherein said first leg member and said second leg member are arranged generally perpendicular to said central portion.

7. The handle arm assembly of claim 6 wherein said arm portion projects in a direction from one of said first leg member and said second leg member.

8. The handle arm assembly of claim 7 wherein said arm portion is of generally planar shape.

9. The handle arm assembly of claim 8 wherein said direction is generally perpendicular to said one of said first leg member and said second leg member.

10. The handle arm assembly of claim 9 wherein said central portion is structured to be coupled to a handle member.

11. A circuit interrupter comprising:

a housing;

separable contacts;

an undervoltage release comprising an undervoltage relay comprising a plunger that is extended to a trip position when voltage in a protected circuit drops below a predetermined value, and a reset mechanism that retracts the plunger when actuated; and an operating mechanism structured to open and close said separable contacts, said operating mechanism comprising:

a handle portion;

a body portion coupled to said handle portion and being rotatable through an arc between an on position, an off position, and a reset position beyond the off position; and an arm portion projecting laterally from the body portion out of the plane of the arc through which the body portion rotates, said arm portion engaging said reset mechanism in a manner such that arcuate movement of the arm portion as the handle portion moves said body portion to the off position is translated into actuation of the reset mechanism, wherein said body portion and said arm portion are formed from a single piece of material; wherein said body portion and said arm portion are different portions of said single piece of material; wherein the single piece of material includes an elongated opening between said body portion and an elongated portion corresponding to said arm portion; and wherein said elongated portion is disposed perpendicular to said body portion to form said arm portion.

12. The circuit interrupter of claim 11 wherein said reset mechanism comprises a reset lever that retracts the plunger when actuated, and an interface lever between said arm portion and said reset lever.

13. The circuit interrupter of claim 11 wherein said single piece of material is made of 1070 steel.

14. The circuit interrupter of claim 11 wherein said body portion and said arm portion are formed using a progressive die.

15. The circuit interrupter of claim 11 wherein said body portion comprises:

a central portion coupled to said handle portion, said central portion having a first end and an opposite second end;

a first leg member extending from the first end of said central portion; and a second leg member extending from the opposite second end of said central portion.

16. The circuit interrupter of claim 15 wherein said central portion, said first leg member, and said second leg member are each of generally planar shape; and wherein said first leg member and said second leg member are arranged generally perpendicular to said central portion.

17. The circuit interrupter of claim 16 wherein said arm portion projects in a direction from one of said first leg member and said second leg member.

18. The circuit interrupter of claim 17 wherein said arm portion is of generally planar shape.

19. The circuit interrupter of claim 18 wherein said direction is generally perpendicular to said one of said first leg member and said second leg member.

* * * * *